United States Patent [19]

Llames

[11] Patent Number: 4,665,641

[45] Date of Patent: May 19, 1987

[54] QUICK POINT REVERSIBLE SLING SWIVEL FOR RIFLE AND SHOTGUNS

[75] Inventor: Emiliano C. Llames, Manila, Philippines

[73] Assignee: Oscar Nepomuceno, Avon Lake, Ohio ; a part interest

[21] Appl. No.: 809,490

[22] Filed: Dec. 16, 1985

[30] Foreign Application Priority Data

Jan. 7, 1985 [PH] Philippines ..... 9170[U]

[51] Int. Cl.[4] ..... F41C 23/02

[52] U.S. Cl. ..... 42/85

[58] Field of Search ..... 42/85; 224/150, 913; 24/2.5, 265 R, 265 AL, 265 BC, 265 CD, 198, 200

[56] References Cited

U.S. PATENT DOCUMENTS

| | | | |
|---|---|---|---|
| 2,335,357 | 11/1943 | Pugsley et al. | 42/85 |
| 2,350,484 | 6/1944 | Williams | 42/85 |
| 2,639,480 | 5/1953 | Magid | 42/85 |
| 2,885,812 | 5/1959 | Arpin | 42/85 |
| 4,299,343 | 11/1981 | Atchisson | 224/150 |
| 4,571,872 | 2/1986 | Johnson | 42/85 |

FOREIGN PATENT DOCUMENTS

| | | | |
|---|---|---|---|
| 85/00423 | 1/1985 | World Int. Prop. O. | 42/85 |

*Primary Examiner*—Charles T. Jordan
*Attorney, Agent, or Firm*—Roy F. Hollander

[57] ABSTRACT

A sling assembly for a rifle, shotgun, or similar firearm consists of a butt portion (1) of the stock of a rifle, a rear or first multi-directional swivel (3) which is pivotally attached between the toe and the heel of the same butt portion of the stock of the firearm, a fore-end portion (2) of the stock of the same firearm, a front or second multi-directional swivel (4) which is pivotally attached to one of the two sides of said fore-end portion (2) of the same firearm stock, and connected to the rear of the first multi-directional swivel (3) and the front or second multi-directional swivel (4) is a sling or strap (5) whose length is adjustable. A firearm equipped with this sling assembly can be carried conveniently in various ready-to-fire and well balanced positions without tiring the arms of the person carrying the firearm and can be fired quickly with considerable accuracy since the first swivel (3) guides the butt (1) to the correct point of the shoulder. In target shooting the strap (5) is adjusted so that the first swivel (3) braces the butt against the shoulder and the forearm portion is supported by the second swivel (4) from the back of the shooter—score goes up! By pushing the rifle towards the target, full automatic fire is controlled.

10 Claims, 6 Drawing Figures

QUICK POINT REVERSIBLE SLING SWIVEL FOR RIFLE AND SHOTGUNS

DESCRIPTION

TECHNICAL FIELD

This invention relates to swivels and more particularly to a quick-point reversible sling swivel for rifles, shotguns and the like.

BACKGROUND OF THE INVENTION

Conventional slings for rifles have their rear swivels attached to the toes of the rifle butts and their front swivels to the bottoms of the fore-ends of the rifle stocks. The main purpose of this kind of sling assembly is to carry the rifle at the back of a person during parades or long hikes.

In target practice, when the shooter is in a prone, sitting or kneeling position, the sling is used to make a not-so-rigid brace for the arm that supports the rifle under the barrel. However, in combat or in fast shooting, the same sling becomes superfluous and cumbersome. In case of emergency, such as during ambuscades, it takes a long time and deliberate movement to untangle the sling from the shoulder and put the rifle at firing position. Precious seconds are lost and the delay may cost a life.

European soldiers have made some improvement by attaching the swivels at the side of their submachineguns so that they can fire the same from waist or hip level during emergencies with the sling still attached at their shoulders. But firing the firearms from the hips or waist level requires a lot of practice and consumption of a considerable quantity of ammunition. Some users of submachineguns have developed the tendency to "walk" the bullets towards the targets, and hitting the target beyond ten meters from the waist or hip level becomes guesswork.

The present sling assembly, as embodied in this invention, allows a rifle, shotgun or submachinegun to be carried in a ready position at a waist or hip level parallel to the ground, in a well balanced position without tiring the arms of the soldier. At this ready position, the firearm can be fired instantly from the waist or hip and, more importantly, can be mounted at the shoulder and fixed at eye level for accurate firing or shooting.

SUMMARY OF THE INVENTION

An object, therefore, of this invention is to provide a sling assembly for a rifle, shotgun or similar firearm that considerably increases the usefulness of the firearm.

Another object of this invention is to provide a sling assembly for a rifle, shotgun or similar firearm which allows said firearm, when carried while sitting or in a standing position, to have its sling secured across the shoulder of the soldier or hunter and to have the grip held comfortably by one hand.

Another object of this invention is to provide a sling assembly for a rifle, shotgun or similar firearm which allows said firearm to be carried conveniently in a ready-to-fire and well balanced position by securing its sling across the shoulder of the soldier or hunter with the firearm parallel to the ground, which allows the firearm to be carried at hip or waist level at the left or right side for left handed or right handed shooters by merely reversing the position of the sling, and which allows the user to hold the firearm grip with only one hand, or with both hands free, or with the firearm vertical to the ground, while its weight is borne through the shoulder, thus preventing undue strain on the arm.

Still another object of this invention is to provide a sling assembly for a rifle, shotgun or similar firearm which allows said firearm to be fired instantly from the waist or hip level, if necessary, but more importantly moved instantly upward and mounted at the shoulder and fired at eye level with considerable accuracy. The sling assembly automatically guides the butt to the correct point at the shoulder.

A further object of this invention is to provide a sling assembly for a rifle, shotgun or similar firearm which allows a soldier or hunter while sitting down or relaxing, or even while sleeping, to have the sling across his shoulder but ensures that he can immediately put said firearm in a ready-to-fire position in case of emergency.

A further object of this invention is to provide a sling assembly for a rifle, shotgun or similar firearm whose sling portion aids the shooter in steadying his firearm not only in conventional or target positon, but also in firing on full automatic in actual combat.

Other objects and advantages of this invention will become clear and apparent as this specification proceeds.

DESCRIPTION OF A PREFERRED EMBODIMENT

Figure 1:
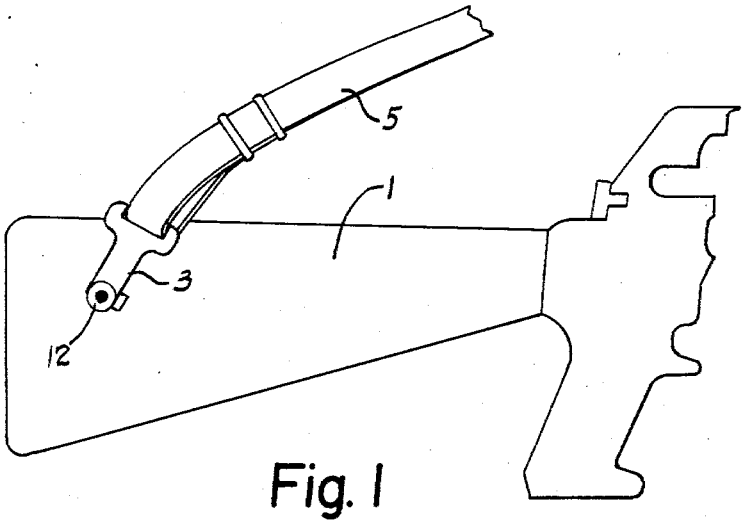
FIG. 1 is a partial and side elevational view of a military rifle butt with a sling swivel assembly and showing its sling portion positioned above the rifle using this new rear sling swivel assembly.
Figure 2:
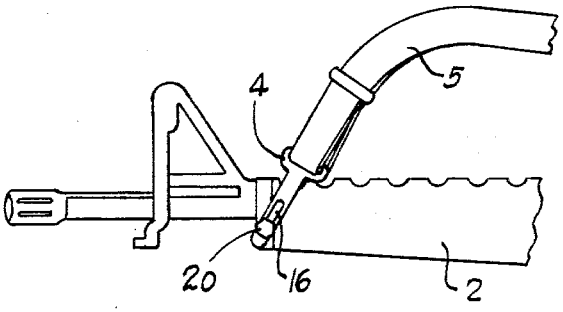
FIG. 2 is a partial and side elevational view of a military rifle fore-end with a sling assembly and showing its sling portion positioned above the rifle using the new fore-end sling swivel assembly.
Figure 3:
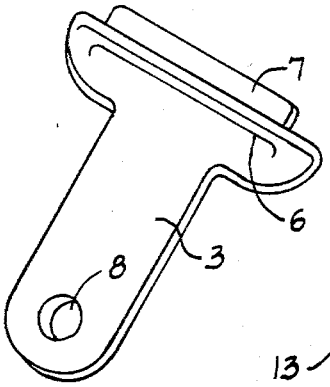
FIG. 3 is a perspective view of the rear swivel of the assembly.
Figure 4:
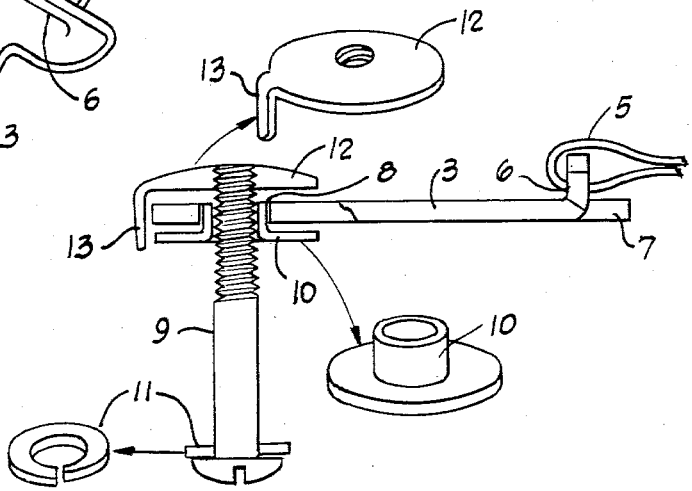
FIG. 4 is a side elevational view of the butt sling swivel assembly showing the respective positions of the components which comprise the assembly.
Figure 5:
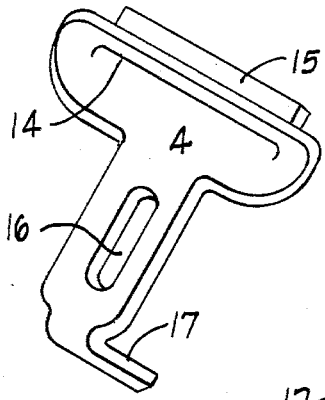
FIG. 5 is a perspective view of the fore-end swivel of the assembly.
Figure 6:
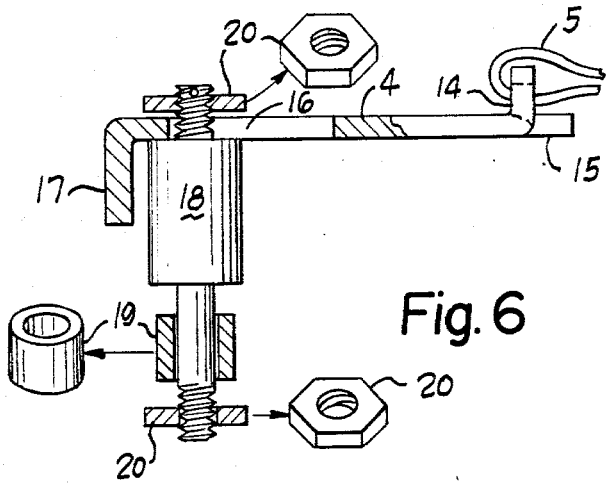
FIG. 6 is a side elevational view of the fore-end sling swivel assembly showing the respective positions of the components which comprise the assembly.

Referring to FIGS. 1 to 6 a sling swivel assembly according to this invention includes a rear portion of the butt 1 of a firearm stock, a fore-end 2 of the same firearm, a rear swivel 3 pivotally attached between the toe and the heel of the butt 1, a front swivel 4 pivotally attached to the fore-end 2 of the firearm and a sling or strap 5 of considerable length whose ends are connected to the rear swivel 3 and the front swivel 4.

The rear swivel 3 has a T-shape with an elongated slot 6 at its enlarged outer end portion through which the sling or strap 5 is inserted. As a result of bending the slot 6 upward and rearward, a protrusion or tongue 7 protrudes at the outer end of the swivel 3. This tongue 7 prevents the sling 5 from scraping the surface of the butt 1.

The rear swivel 3 has also at its pivotal end a hole 8 and forming part of this rear swivel assembly are the required fittings consisting of a bolt 9 or screw, a sleeve and washer combination 10, a lockwasher 11 to prevent the bolt 9 from loosening, and a round nut 12. The diameter of this round nut 12 is slightly wider than the pivotal end of the swivel 3, and has a tail-like appendage which we shall call a retainer 13 which slightly penetrates the butt 1, thus preventing the round nut 12 from loosening from the bolt 9. More importantly, the retainer 13 prevents the swivel 3 from rotating a complete 360 degrees, thus preventing the twisting of the sling 5. In wooden butts, a wood screw can be used instead of a bolt 9 and the lock-washer removed.

The fore-end swivel 14 is also T-shaped with an elongated slot 14 at its enlarged outer end portion through which the sling 5 is inserted. It also has a tongue 15. The fore-end swivel 4 has a longitudinal hole 16 running along its narrow and pivotal end. This elongated hole 16 allows the swivel 4 to extend or retract to make it self-adjusting. At the end of this narrow and pivotal end is another tail-like appendage called a retainer 17 which also prevents the swivel 4 from rotating completely thus preventing the sling 5 from twisting. Forming part of this fore-end swivel is a bolt 18 with an enlarged mid-portion, a sleeve 19 and a nut 20.

I claim:

1. A sling assembly for a long firearm comprising, a butt portion of the stock of said firearm, a first multidirectional swivel pivotally attached between the toe and the heel of said butt portion, a fore-end of the stock of said firearm, a second multidirectional swivel pivotally attached to one side of said fore-end portion of said stock, said second swivel having an elongated slot at the pivotal end which allows the swivel to extend or retract, each of said multidirectional swivels having a slot at its outer end for insertion of a strap designed so as to prevent the strap from slipping or scraping against the firearm, and a strap, one end of which is attached to the first multidirectional swivel and the other end of which is attached to the second multidirectional swivel and which is adjustable in length, said strap being adapted to be easily positioned above or below said firearm when the latter is in horizontal firing position and allowing said firearm to be carried conveniently in various positions that can be instantly put into firing position.

2. A sling assembly for a long firearm comprising, a butt portion of a stock of said firearm, a first multidirectional swivel pivotally attached between the toe and the heel of said butt portion, a fore-end of the stock of said firearm, a second multi-directional swivel pivotally attached to one side of said fore-end portion of said stock, each of said multidirectional swivels having a slot at its outer end for insertion of a strap designed so as to prevent the strap from slipping or scraping against the firearm, restraining means for preventing each of said swivels from pivoting through a full circle, and a strap, one end of which is attached to the first multidirectional swivel and the other end of which is attached to the second multidirectional swivel and which is adjustable in length, said strap being adapted to be easily positioned above or below said firearm when the latter is in horizontal firing position and allowing said firearm to be carried conveniently in various positions that can be instantly put into firing position.

3. A sling assembly for a long firearm having a stock with a butt portion and a fore-end portion, comprising a first multidirectional swivel, means for pivotally attaching said first swivel to one of said butt portion and said fore-end portion, restraining means for preventing said first swivel from pivoting through a full circle, a second multidirectional swivel, means for pivotally attaching said second swivel to the other of said butt portion and said fore-end portion, and a strap attached at one end to said first multidirectional swivel and at the other end to said second multidirectional swivel.

4. A sling assembly according to claim 3 including means for preventing said second multidirectional swivel from pivoting through a full circle.

5. A sling assembly according to claim 3 wherein said restraining means for said first swivel includes a member having an a extending across the pivotal path of said swivel.

6. A sling assembly according to claim 3 wherein said restraining means for said first swivel includes an appendage on said first swivel extending in a direction transverse to the pivotal path of said first swivel.

7. A sling assembly according to claim 3 wherein one of said first and second multidirectional swivels has an elongated slot at the pivotal end which allows the swivel to extend or retract.

8. A sling assembly for a long firearm having a stock with a butt portion and a fore-end portion comprising, a first multidirectional swivel, means for pivotally attaching said first swivel to one of said butt portion and said fore-end portion, said first swivel having a flat body, a slotted portion extending transversely from said body for receipt of a strap, and a tongue portion extending coplanar with said body beyond said slotted portion for preventing a strap in said slotted portion from scraping against a firearm, a second multidirectional swivel, means for pivotally attaching said second swivel to the other of said butt portion and said fore-end portion, and a strap attached at one end to said first multidirectional swivel and at the other end to said second multidirectional swivel.

9. A sling assembly according to claim 8 wherein said second swivel includes a flat body, a slotted portion extending transversely from said body for receipt of said strap and a tongue portion extending coplanar with said body beyond said slotted portion for preventing said strap in said slotted portion from scraping against a fire arm.

10. A sling assembly according to claim 8 wherein one of said first and second swivels has an elongated slot at the pivotal end which allows the swivel to extend or retract.

* * * * *